United States Patent [19]

Raber et al.

[11] Patent Number: 4,769,646

[45] Date of Patent: Sep. 6, 1988

[54] ANTENNA SYSTEM AND DUAL-FED LENSES PRODUCING CHARACTERISTICALLY DIFFERENT BEAMS

[75] Inventors: Peter E. Raber, Milford; John H. Cross, Weston, both of Conn.

[73] Assignee: United Technologies Corporation, Hartford, Conn.

[21] Appl. No.: 584,273

[22] Filed: Feb. 27, 1984

[51] Int. Cl.[4] ..... H01Q 15/08

[52] U.S. Cl. ..... 343/753; 343/911 R

[58] Field of Search ..... 343/753, 754, 755, 909, 343/910, 911 R

[56] References Cited

U.S. PATENT DOCUMENTS

| | | | |
|---|---|---|---|
| 2,530,580 | 11/1950 | Lindenblad | 343/753 |
| 2,599,864 | 6/1952 | Robertson et al. | 343/755 |
| 2,975,419 | 3/1961 | Brown | 343/754 |
| 3,146,451 | 8/1964 | Sternberg | 343/753 |
| 3,170,158 | 2/1965 | Rotman | 343/753 |
| 3,189,907 | 6/1965 | Buskirk | 343/753 |
| 3,281,850 | 10/1966 | Hannan | 343/909 |
| 3,287,728 | 11/1966 | Atlas | 343/753 |
| 3,413,637 | 11/1968 | Goebels et al. | 343/754 |
| 3,631,503 | 12/1971 | Tang et al. | 343/754 |
| 3,688,311 | 8/1972 | Salmon | 343/755 |
| 4,309,710 | 1/1982 | Cassel | 343/754 |
| 4,489,331 | 12/1984 | Salvat et al. | 343/753 |

FOREIGN PATENT DOCUMENTS

| | | | |
|---|---|---|---|
| 2738549 | 3/1979 | Fed. Rep. of Germany | 343/754 |
| 53-27347 | 3/1978 | Japan | 343/753 |
| 54-132156 | 10/1979 | Japan | 343/753 |

*Primary Examiner*—William L. Sikes
*Assistant Examiner*—Michael C. Wimer

[57] ABSTRACT

A radar antenna arrangement with at least a pair of feeds, said arrangement including a corresponding at least a pair of lens elements, the element closest to said feeds effective for collimating the output beam of each of said feed, and the remaining ones of said elements each being associated with a different one of said feeds, whereby at least a pair of separate antenna beams are capble of projection toward a target region.

5 Claims, 4 Drawing Sheets

FIG. 1
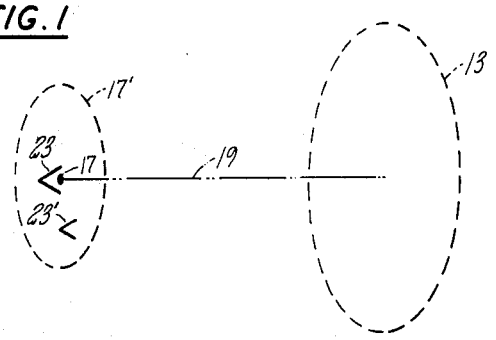
FIG. 2
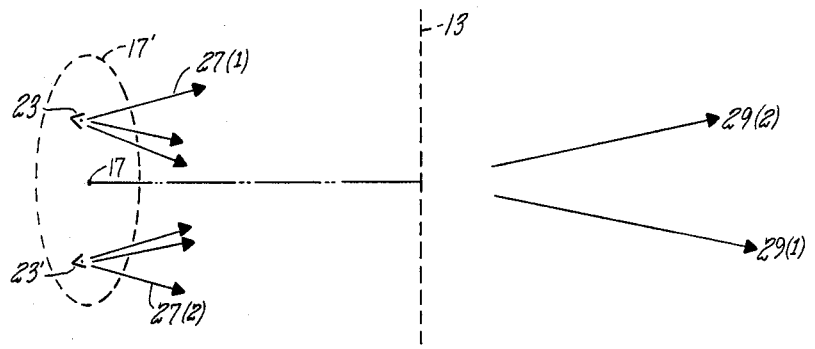
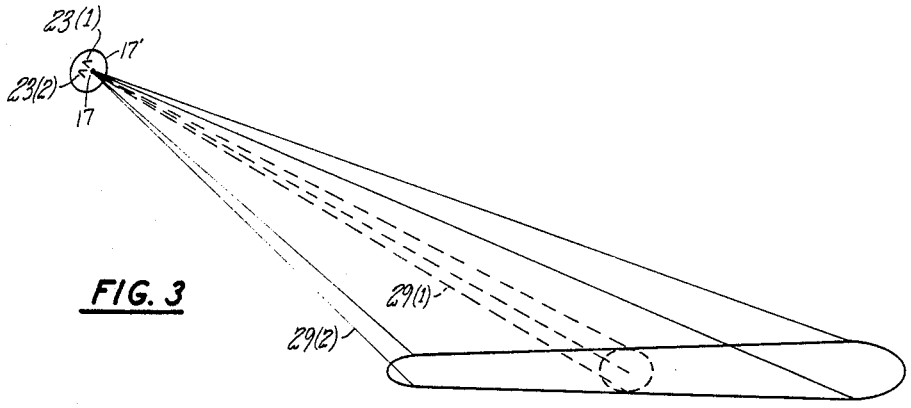
FIG. 3

ANTENNA SYSTEM AND DUAL-FED LENSES PRODUCING CHARACTERISTICALLY DIFFERENT BEAMS

The Government has rights in this invention, pursuant to Contract No. DAAK21-81-C-0089 awarded by the Department of the Army.

TECHNICAL FIELD

This invention is directed toward the art and technology of radar antenna systems and more particularly toward the use of off-axis and multiple feeds not precisely located at the radar antenna focal point.

BACKGROUND ART

Radar systems of the prior art typically position a single feed at the antenna focal point. Such antennas further are designed to optimize beam collimation and focusing with respect to the focal point. This generally limits the antennas of the prior art to a single antenna feed, and makes them generally unsuited for multimode applications.

There are known exceptions to the single feed at the focal point approach, but these are generally expensive approaches, which additionally frequently require the acceptance of degradation in gain and resolution. Such approaches include phased array sources, and Luneberg lenses, and extended feed systems.

Accordingly, it is an object of the instant invention to develop a multiple feed microwave antenna in which the feeds are positionable at a distance removed from the focal point of the antenna.

It is a further object of the invention to establish a high gain multiple feed antenna arrangement in which the antenna feeds are removed a distance from the focal point of the antenna.

It is a further object of the invention to develop a multimode antenna which can provide more than one antenna function or mode using a single shared antenna aperture.

It is a further object of the invention to develop a relatively compact, inexpensive, and reliable off focal-point antenna feed arrangement for multimode microwave radar application.

It is a further object of the invention to develop a new and improved multimode off focal-point antenna feed arrangement which is particularly suited for millimeter and submillimeter wavelength radar application.

DISCLOSURE OF INVENTION

The invention is directed toward a multimode radar antenna arrangement in which the feeds are removed from the focal point of the antenna. By employing several feeds, the passive antenna aperture is illuminated by several beams of microwave energy, which can accomplish independent functions using a single antenna aperture, and thus enhance the operational capabilities of the antenna system as a whole.

For example, one of the beams can be employed in a broad beam search mode to seek out potential target signals; another beam, much narrower in beamwidth, can then be employed to track an acquired target.

To accomplish this purpose, the invented antenna arrangement establishes a large focal region—as opposed to a mere focal "point"—which can be employed to position several spaced feed structures.

The design is carried out by minimizing off-axis optical aberrations throughout the required angular field and limiting total aberration to less than that produced by diffraction for the size and shape of the preferred antenna employed in the system.

The design is made compact with no sacrifice in performance by including a significant "shared" region of the antenna aperture which can be illuminated by more than one of the multiple feeds. However, the independent nature of each of the output beams is maintained without regard to whether this shared region is illuminated by feeds other than that associated with the beam.

BRIEF DESCRIPTION OF DRAWINGS

FIG. 1 shows a schematic antenna including a characteristic focal point, and a focal region within which the feeds of the invention herein can effectively be positioned;

FIG. 2 shows a preferred lens embodiment of the invention with two feeds acting as sources effective for producing a corresponding pair of antenna beams;

FIG. 3 shows a preferred version of the invention in which a pair of beams are produced, one of them being formed for example in the shape of a fan beam to search for targets, and the other acting as a pencil beam to track the target once acquired;

BEST MODE FOR CARRYING OUT THE INVENTION

Figure 4:
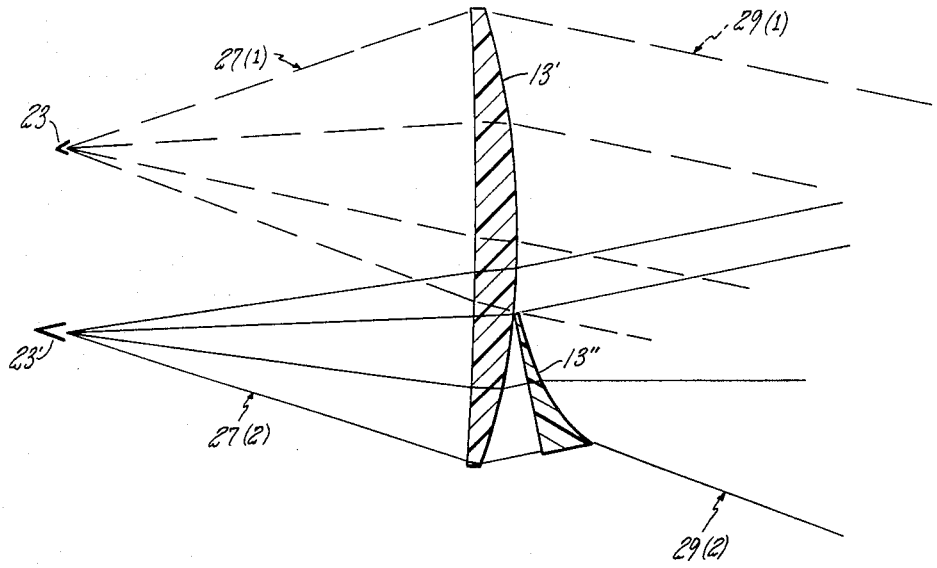
FIG. 4 shows a multiple lens version of the antenna including fan and pencil beam feeds cooperating respectively with the secondary and primary lens of the arrangement.

FIG. 1 illustrates a significant difference between the prior art and the invention herein. In particular, it can be seen in the Figure that for a typical antenna arrangement of the prior art including an antenna 13 characterized by a focal point 17 along the antenna axis 19, there can be only a single antenna feed structure 23. If another antenna feed structure 23' were moved to the position of the focal point 17, the second structure 23' would physically displace and interfere with the position of the first structure 23. If the second structure 23' were not moved to the focal point 17, the collimation and focusing quality of the associated beam from the antenna would be degraded, resulting in a loss of gain and resolution.

However, in the invention to be described in detail herein, a focal region 17' is established which has dimensions permitting the positioning of several antenna feed structures in the proximity of the focal point 17, with substantially no sacrifice in beam quality.

FIG. 2 shows two feed structures, respectively 23 and 23', both positioned within the focal area 17'. These are effective for producing corresponding antenna illumination beams 27(1) and 27(2). The beams 27 pass through the antenna 13 in this case, as the antenna of the preferred embodiment is a lens-type antenna, and are reformed by the antenna into output beams 29(1) and 29(2) respectively.

FIG. 3 shows a preferred version of the antenna arrangement in which the antenna produces two beams 29(2) and 29(1) including respectively a fan beam relatively narrow in azimuth but wide in elevation for searching out targets, and a relatively narrow symmetric pencil beam effective for tracking targets which have been acquired by the search effort of the fan beam. The fan beam itself is one of a category of wide beams which can be formed according to specific design.

A preferred embodiment of the invention employs an antenna diameter exceeding several dozen wavelengths. The invention is applicable to millimeter and submillimeter wavelength systems, for example. Significantly smaller diameters of the antenna 13 derogate the intended focusing and collimating effects of the antenna.

The embodiment of FIG. 4 is a preferred version of the invention. In particular, the version employs primary and secondary lens, respectively 13' and 13", to perform the antenna function. Two feed structures 23 and 23' are employed in conjunction with the respective lens.

The beam 27(1) from the first feed structure 23 passes through the primary lens 13' which causes the output pencil beam 29(1) to be collimated. The beam 27(2) from the second feed structure 23' also passes through the primary lens 13' and is thus also collimated; however, a portion thereof then passes through the secondary lens 13" which is effective for broadening the beam into a divergent fan beam pattern of microwave radiation. Nonetheless, the entire fan beam does not pass through the secondary lens. A portion of it remains collimated and passes by the secondary lens 13" in unimpeded intensity.

Figure 5:
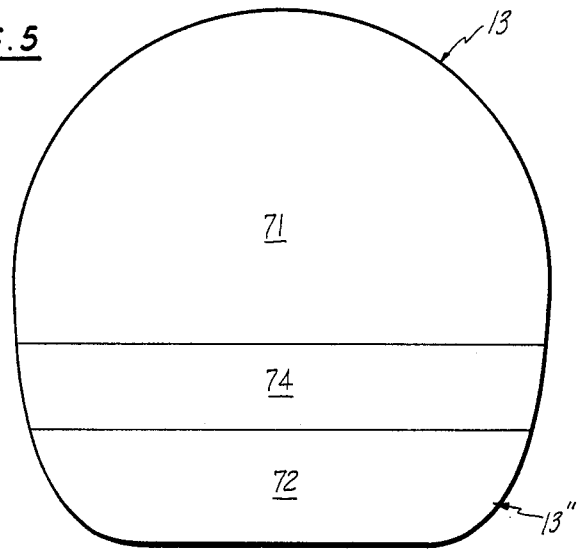
FIG. 5 shows the scheme of the antenna aperture based upon the version of the invention indicated in FIG. 4, which is divided into regions corresponding to the primary and secondary beams and a region of beam overlap.

The antenna aperture or surface can therefore be said to be divided into three primary regions, as indicated in FIG. 5. The view shown in the Figure is from a frontal direction toward the antenna 13 itself.

As suggested by this view, a major portion 71 of the surface of the antenna is dedicated to the projection of the pencil beam. In particular, this portion 71 of the antenna 13 effectively collimates the radiation produced from the first feed structure 23.

The lower portion 72 of the antenna surface is devoted to forming the fan beam for example, which is derived from the second feed structure 23'. After passing through this portion of the antenna, the beam begins to diverge toward the target region.

Finally, there is a shared portion 74 of the antenna surface between the upper and lower portions, through which both the fan and the pencil beams pass and effectively remain in a collimated state after transit therethrough. The secondary lens 13" preferably does not extend into the shared portion 74 of the antenna surface. This reduces losses in the collimated portion of the output beams.

The feeds themselves 23 and 23' are effective for directing microwave energy toward these respective regions of the antenna. This is best explained by reference to FIGS. 6A and 6B, which show the relative disposition of feeds to the antenna of the invention herein according to FIG. 4.

Figure 6A:
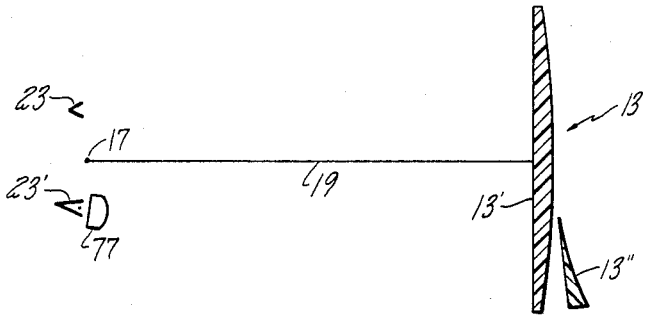
FIGS. 6A and 6B respectively show two views of the preferred antenna arrangement including the placement of the antenna feeds, the first view being from the side, and the second from below.
Figure 6B:
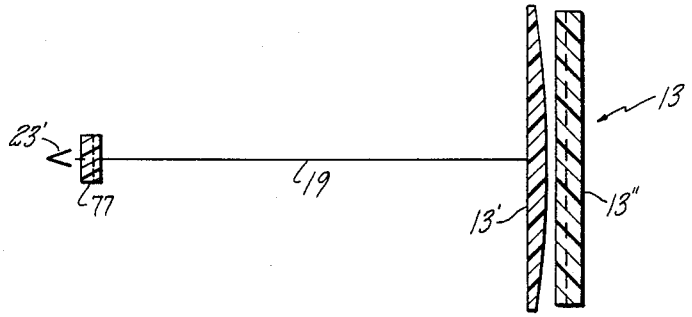

In particular, FIG. 6A shows a side view of the arrangement of primary and secondary feeds, respectively 23 and 23'. FIG. 6B shows a corresponding bottom view thereof.

The feeds 23 and 23' are suitably supported and arranged in a support structure including a source of microwave power and suitable circuitry (not shown) for controlling the timing and level of microwave power supplied through the respective feeds. Typically, the microwave power is generated in a linearly polarized form and may for example according to a preferred version of the invention be converted to circularly polarized radiation. This is accomplished for example by positioning circular polarizers at the outputs of the respective feeds prior to its reaching the antenna for collimation.

In a preferred embodiment of the invention, the beam from the second feed structure 23' is compressed by a cylindrical lens 77 as indicated in FIG. 6B. As the beam initially departs from the feed, it is generally rotationally symmetric about the axis of its direction of propagation toward the lower and shared regions of illumination 72 and 74 indicated in FIG. 5.

However, as can be seen in FIG. 5, the lower and shared regions of the antenna aperture toward which the fan beam is directed are not circular in shape and accordingly do not conform to the cross section of a rotationally symmetric beam. An incident beam having a perpendicular cross section more in the nature of an ellipse would conform to the shape of the region to a significantly greater extent.

It follows that a cylindrical lens 77 at the output of the second feed 23' disposed to compress the output beam in altitude and leaving it generally unaffected in azimuth is effective in conforming the cross section of the beam to the shape of the antenna aperture to which it corresponds, especially since the secondary lens 13" of the antenna arrangement itself is preferably cylindrical in nature.

Figure 7:
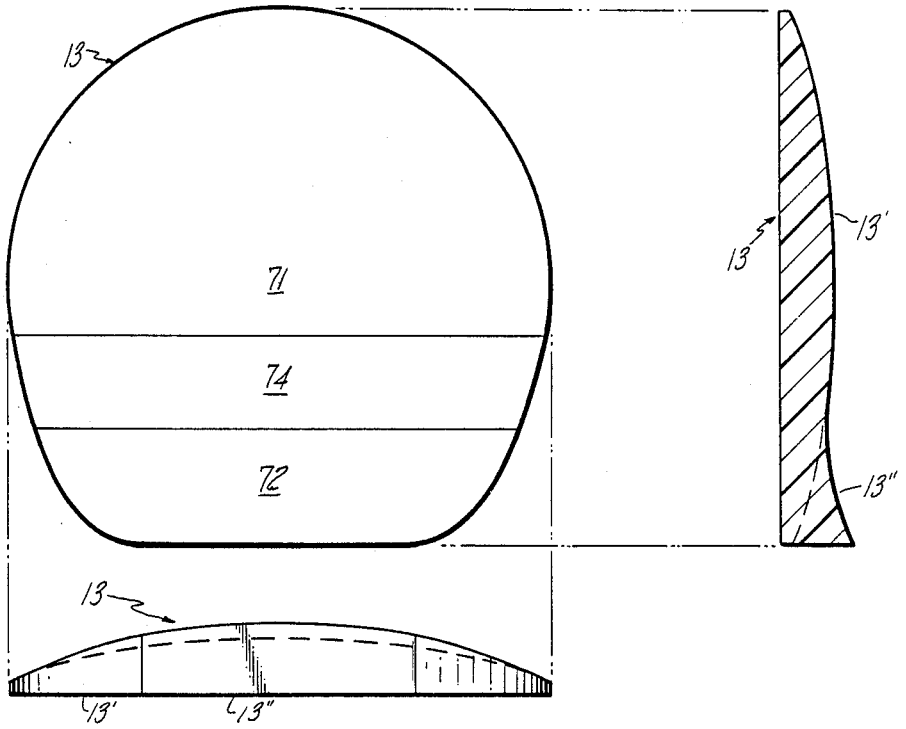
FIG. 7 indicates a version of the invention in which the antenna lens is monolithically constructed, thereby combining the functions of the primary and the secondary lens in a single lens.

The antenna lens is capable of establishment in several pieces separately assemblable as indicated in FIG. 4, or in a single manufactured piece as suggested in FIG. 7. According to this version of the invention, the antenna lens is molded, machined, or otherwise fabricated, as a single, monolithic piece.

Figure 8:
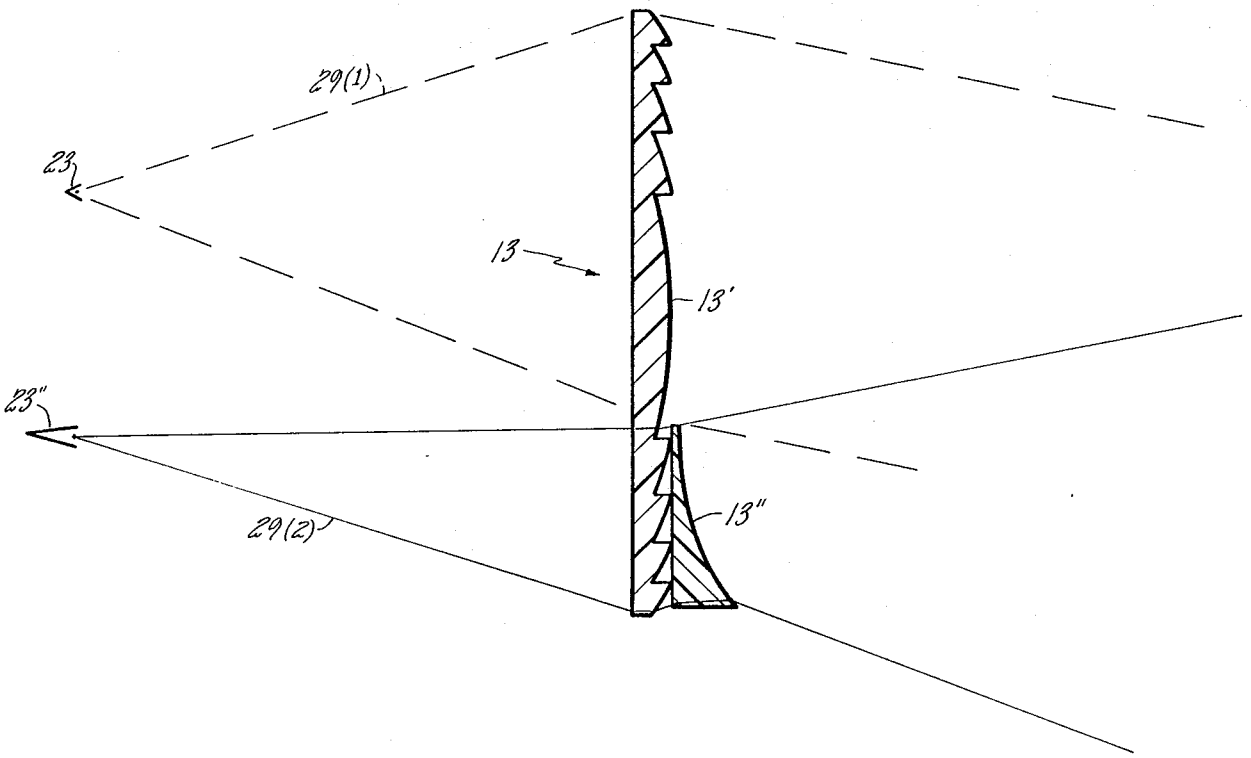
FIG. 8 shows a version of the invention based upon the embodiment shown in FIG. 4, in which however a portion of the primary lens is stepped according to the nature of a Fresnel lens.

FIG. 8 shows a stepped version of the primary lens 13' in the form of a Fresnel lens, which provides for a more compact lens construction, reduces the weight of the entire assembly and reduces absorption losses in the microwave radiation passing through the lens.

A preferred material for this embodiment of the antenna lens is a dielectric such as alumina or a similar ceramic, glass or polymer such as a cross-linked polystyrene, such as Rexolite. Once the material is established, it can suitably be machined or ground and polished or molded to the desired shape; in the case of ceramics such as alumina, either molding or machining in a green state is preferable before firing.

The size of the antenna cross section for a preferred embodiment operating at a millimeter wave frequency of about 94 GHz, is preferably about 300 millimeters, or approximately one foot across, and the arrangement has a similar focal length enabling the arrangement to be effective in its illumination and energy gathering function. These dimensions make the antenna arrangement particularly suitable for millimeter and submillimeter wavelength radar application. The shape of the primary lens 13' varies according to the refractive index of the material employed to make the arrangement. In one preferred embodiment in which the selected material to make the lens is a cross-linked polystyrene, the input side of the primary lens is preferably flat and the output side is an elliptical conic section of revolution whose axis of symmetry coincides with the optical axis. In another preferred embodiment in which the material is alumina, the input side of the primary lens is preferably spherical and the output side is an elliptical conic section of revolution whose eccentricity is lower than that required for the polystyrene lens.

The output side of the secondary lens 13" has a selected shape effective for establishing a desired distribution of intensity versus elevation angle. In a preferred embodiment of the invention, the desired distribution is the cosecant of theta squared times the square root of the cosine of theta, where theta is the elevation angle. The angle theta is the angular deviation from the line of sight to the target region. In order to achieve this condition, the cross-sectional shape of the output side of the secondary lens is generally not a simple conic section and it varies according to the material of which the lens is constituted.

Additionally, to prevent aberrations of the secondary lens from affecting azimuth collimation, the surface of the secondary lens 13" closest to the primary lens 13' is preferably flat and perpendicular to the output beam from the primary lens 13'. For the sake of convenience in construction, a slight deviation from the perpendicular may be taken, however, in mounting the secondary lens 13" directly on the bottom portion of the primary lens 13', as for example suggested in FIG. 8. When this is done, the contour of the curved surface of the secondary lens is preferably slightly different than when the flat surface is perpendicularly oriented, in order to maintain the desired distribution of intensity versus elevation angle.

In lieu of the lens arrangements described herein, the same principles can be applied with reflector type antennas as well.

The information above may be indicative of other versions of the invention, which are likely to occur to one skilled in the art to which the invention is related. These come within the scope of the claims below to the extent that the claims themselves define the metes and bounds of the invention.

We claim:

1. A radar antenna and lens system for illuminating a target region, comprising:

first and second dielectric radar lenses fixed in space within an aperture having an aperture border, for modifying radar signals to shape radar beams, each of said first and second dielectric radar lenses having a non-planar lens surface located on an outer side of said first and second dielectric radar lens, said first dielectric radar lens being centered along an optic axis having azimuthal symmetry about axis and substantially filling said aperture, and said second dielectric radar lens being disposed in a predetermined position offset from said optic axis and abutting said aperture border;

first and second spaced feed means for sending and receiving radar signals, each of said feed means being spaced with respect to one another and transversely with respect to said optic axis at a common feed region related to said first dielectric radar lens and being directed toward said aperture, said first dielectric radar lens being shaped and positioned relative to said first feed means to collimate radiation emitted therefrom, characterized in that:

said first and second feed means are electrically independent, whereby they do not cooperate to form a single beam;

said second feed means is positioned and oriented to direct radiation preferentially through said second dielectric radar lens and said second dielectric radar lens is displaced from said axis such that it intercepts radiation from substantially only said second feed means, whereby said system is effective for directing characteristically different radar beams in the direction of a target region including a first collimated beam from said first feed means and a second beam having a non-collimated beam shape;

said first dielectric radar lens has a non-spherical outer surface having a surface contour that is an elliptical conic section of revolution centered about said optic axis, whereby said first dielectric radar lens has a focal region extending transversely from said optic axis and encompassing said feed region and directs a collimated pencil beam toward said target region; and said second dielectric radar lens is shaped to produce a fan beam from radiation emitted by said second feed means, whereby said pencil beam and said fan beam share said aperture.

2. The invention of claim 1, wherein said first dielectric radar lens is fashioned from alumina material and has an inner surface, opposite said outer surface, that has a spherical surface contour.

3. The invention of claim 1, wherein said first dielectric radar lens is made of cross linked polystyrene and has an inner surface, opposite said outer surface, that is planar.

4. A system according to claim 1, in which said first and second dielectric radar lenses are formed from a single block of material.

5. A system according to claim 1, in which said first dielectric radar lens is a Fresnel lens having a surface contour optically equivalent to said outer surface of said first dielectric radar lens.

* * * * *